US007180058B1

(12) United States Patent
Izgarian

(10) Patent No.: US 7,180,058 B1
(45) Date of Patent: Feb. 20, 2007

(54) LDI/MALDI SOURCE FOR ENHANCED SPATIAL RESOLUTION

(75) Inventor: Nicolae Izgarian, San Ramon, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 11/244,626

(22) Filed: Oct. 5, 2005

(51) Int. Cl.
*H01J 49/04* (2006.01)
*H01J 49/26* (2006.01)
*H01J 27/00* (2006.01)

(52) U.S. Cl. ..... 250/288; 250/281; 250/282

(58) Field of Classification Search ..... 250/288
See application file for complete search history.

(56) References Cited

U.S. PATENT DOCUMENTS

| | | | | |
|---|---|---|---|---|
| 5,118,937 | A * | 6/1992 | Hillenkamp et al. | 250/282 |
| 6,680,477 | B2 | 1/2004 | Beck et al. | |
| 6,822,230 | B2 * | 11/2004 | Schleifer et al. | 250/288 |
| 6,963,066 | B2 * | 11/2005 | Izgarian et al. | 250/288 |
| 7,122,790 | B2 * | 10/2006 | Fonash et al. | 250/288 |
| 7,138,625 | B2 * | 11/2006 | Overney et al. | 250/288 |
| 2004/0119013 | A1 * | 6/2004 | Schleifer et al. | 250/288 |
| 2004/0217277 | A1 * | 11/2004 | Goodley et al. | 250/288 |
| 2004/0217278 | A1 * | 11/2004 | Overney et al. | 250/288 |
| 2004/0245453 | A1 * | 12/2004 | Izgarian et al. | 250/288 |
| 2005/0139778 | A1 * | 6/2005 | Overney et al. | 250/423 P |
| 2005/0139779 | A1 * | 6/2005 | Overney et al. | 250/423 P |
| 2006/0186332 | A1 * | 8/2006 | Haase et al. | 250/288 |

FOREIGN PATENT DOCUMENTS

EP 0868740 B1 1/2003

OTHER PUBLICATIONS

Spengler et al., "Scanning Microprobe Matrix-Assisted Laser Desorption Ionization (SMALDI) Mass Spectrometry: Instrumentation for Sub-Micrometer Resolved LDI and MALDI Surface Analysis," J. Am. Soc Mass Spectrom, p. 735-748, (2002).

(Continued)

*Primary Examiner*—Nikita Wells
*Assistant Examiner*—Bernard Souw
(74) *Attorney, Agent, or Firm*—Sharon Upham

(57) ABSTRACT

A MALDI/LDI source is disclosed that includes an ion optical device and beam-focusing optics disposed on opposite sides of a sample support that is at least locally transparent in a region underlying the sample to allow transmission of a radiation beam therethrough. A laser or other radiation source, located adjacent a rear surface of the sample support, emits a beam of radiation that is focused by the beam focusing optics and traverses the transparent region of the sample support to impinge on the sample. Ions produced by irradiation of the sample are collected by an ion optical device located adjacent the front surface of the sample support. By locating the ion optical device and beam-focusing optics on opposite sides of the sample support, short focal length beam-focusing optics may be utilized, thereby facilitating smaller beam spot sizes. This may be particularly useful for mass spectral tissue imaging and other applications where high spatial resolution analysis of a differentiated sample is desirable.

10 Claims, 6 Drawing Sheets

OTHER PUBLICATIONS

Bouschen et al., "Automated 3D-SMALDI Imaging with a Lateral Resolution of 1 μm," Proceedings of the 51st ASMS Conference on Mass Spectrom and Allied Topics, Institute of Inorganic and Analytical Chemistry (Germany), (2003).

Bouschen et al., "SMALDI Imaging at 1 μm Lateral Resolution," Proceedings of the 52nd ASMS Conference on Mass Spectrom and Allied Topics, (May 5, 2004).

Chaurand et al., "MALDI-MS Imaging of Tissue Sections with a Resolution of 10 Microns," Vanderbilt Univ; Univ of Giessen (USA; Germany), Proceedings of the 50th ASMS Conference on Mass Spectrom and Allied Topics, (2002).

Schriver et al., "High Resolution Imaging Mass Spectrometry: Characterization of Ion Yields and Laser Spot Sizes," Vanderbuilt Univ. (USA), Proceedings of the 51st ASMS Conference on Mass Spectrom and Allied Topics, (2003).

Piyadasa et al., "Imaging MALDI with an Orthogonal TOF Mass Spectrometer," Proceedings of the 52nd ASMS Conference on Mass Spectrom and Allied Topics, Dept of Physics and Astronomy, Univ of Manitoba (Canada), (May 5, 2004).

Ens et al, "Molecular Imaging Using an Orthogonal-Injection Time-of-Flight Mass Spectrometer with a Matrix-Assisted Laser Desorption Ionization Source," (Abstract), OSA 94 PC (2004).

Luxembourg et al, "High Spatial Resolution Mass Spectrometric Imaging of Peptide and Protein Distributions on a Surface," Anal Chem, vol. 76 ( No. 18), p. 5339-5344, (2004).

* cited by examiner

LDI/MALDI SOURCE FOR ENHANCED SPATIAL RESOLUTION

BACKGROUND

1. Field of the Invention

The invention is in the field of mass spectrometry and more specifically in the field of ionization sources for mass spectrometry.

2. Related Art

Laser-based ionization techniques, which include laser desorption/ionization (LDI) and matrix-assisted laser desorption/ionization (MALDI), are useful tools for mass spectrometric analysis. These techniques involve irradiating a sample containing an analyte substance with a short pulse of radiation, typically emitted by a laser. The radiation is absorbed by the sample, resulting in the desorption and ionization of analyte molecules from the sample. In the MALDI process, the sample is prepared by associating the analyte substance with a matrix material, which is highly absorbent at the irradiation wavelength and which assists in the desorption and ionization of the analyte molecules. MALDI is a particularly useful technique for the analysis of large biological molecules, such as peptides or proteins, that may undergo fragmentation when subjected to alternative ionization methods. Furthermore, MALDI tends to produce singly-charged ions, thereby facilitating interpretation of the resultant mass spectra. The ions produced by the LDI or MALDI source (or product ions derived therefrom) may be analyzed using any one or combination of mass analyzers known in the art, including quadrupole mass filters, quadrupole ion traps, time-of-flight analyzers, Fourier transform ion cyclotron resonance cells, and electrostatic traps.

Recently, there has been growing interest in the use of LDI/MALDI mass spectrometry to generate spatially resolved maps of analyte concentrations in a biological material, such as a tissue sample. This process, which is often referred to as mass spectral tissue imaging, offers great promise as a tool for the study of drug absorption and excretion by selected tissues. Because analyte concentrations in a tissue sample may exhibit large spatial gradients, it is generally desirable to perform tissue imaging experiments at high spatial resolution in order to gain useful information regarding analyte concentration profiles at areas of interest within the sample.

The minimum spatial resolution that can be obtained using a MALDI or LDI source will be partially determined by the spot size, i.e., the area of the sample that is irradiated by the laser or other irradiation source. In most commercially available MALDI sources, the spot size has a diameter of around 100 μm, which is too large for some tissue imaging applications. The spot size may be reduced by more tightly focusing the radiation beam at the sample surface, e.g., by using a beam-focusing lens having a shorter focal length. However, the presence and positioning in the ionization source chamber of the ion guide or other optics, which transport the ions from the sample location to the mass analyzer, will often interfere with the placement of a short focal length lens, thereby making it difficult or impossible to focus the beam to the desired size. The placement of a short focal length lens may also be rendered more difficult by the presence of discrete viewing optics employed to acquire an image of the sample.

In view of the above discussion, there is a need in the art for an LDI or MALDI source that allows for reduction of the radiation spot size and facilitates tissue imaging or other applications that require high spatial resolution.

SUMMARY

According to embodiments of the present invention, an LDI or MALDI source is provided in which a sample is arranged on a front surface of a sample plate that is at least locally transparent at the irradiation wavelength. In various implementations, the transparency may be achieved by fabricating the sample support from a transparent material, or by fabricating the sample support from a non-transparent material and adapting the sample support with openings or transparent windows in the region or regions underlying the sample(s). An ion optical device, such as a multipole ion guide, is positioned adjacent the sample support front surface for transporting the ions emitted from the sample. Beam-focusing optics, which may include one or more short focal length lenses, are positioned adjacent the rear surface of the sample support. The radiation beam, focused by the beam-focusing optics, traverses the transparent sample plate and impinges upon the sample as a tightly-focused spot to desorbs and ionize the sample.

In some embodiments, viewing optics are disposed adjacent the rear surface of the sample support to enable viewing of an image of the sample by the operator (via, for example, a video camera or other imaging device).

By positioning the beam-focusing optics and/or the imaging optics on a different side of the sample support from the ion optical device, the design of the LDI/MALDI source is less constrained by the limited space around the sample, thereby permitting use of a short focal length beam-focusing lens that must be positioned at close proximity to the sample. Use of a short focal length lens produces a smaller beam spot than would be possible using prior art LDI/MALDI system architectures, which in turn allows for acquisition of mass spectral images at higher resolutions.

DETAILED DESCRIPTION

In one aspect of the invention, a laser desorption/ionization source or matrix-assisted laser desorption/ionization source (referred to collectively as an LDI/MALDI source) is provided which accommodates a sample support configured to support one or more sample(s) on a front surface thereof. The sample support is at least locally transparent at the wavelength of the irradiation beam. Transparency may be provided by the modification of a non-transparent sample support with transparent windows or openings that underlie the sample(s); alternatively, the entire sample support may be constructed from a transparent material such as quartz. Beam focusing optics and/or viewing optics may be disposed adjacent a rear surface of the sample support for, respectively, focusing a beam of radiation onto the sample and acquiring an image of the sample. An ion optical device, such as a multipole ion guide, is disposed adjacent the front surface of the sample support and functions to collect and guide ions produced by irradiation of the sample.

Figure 1:
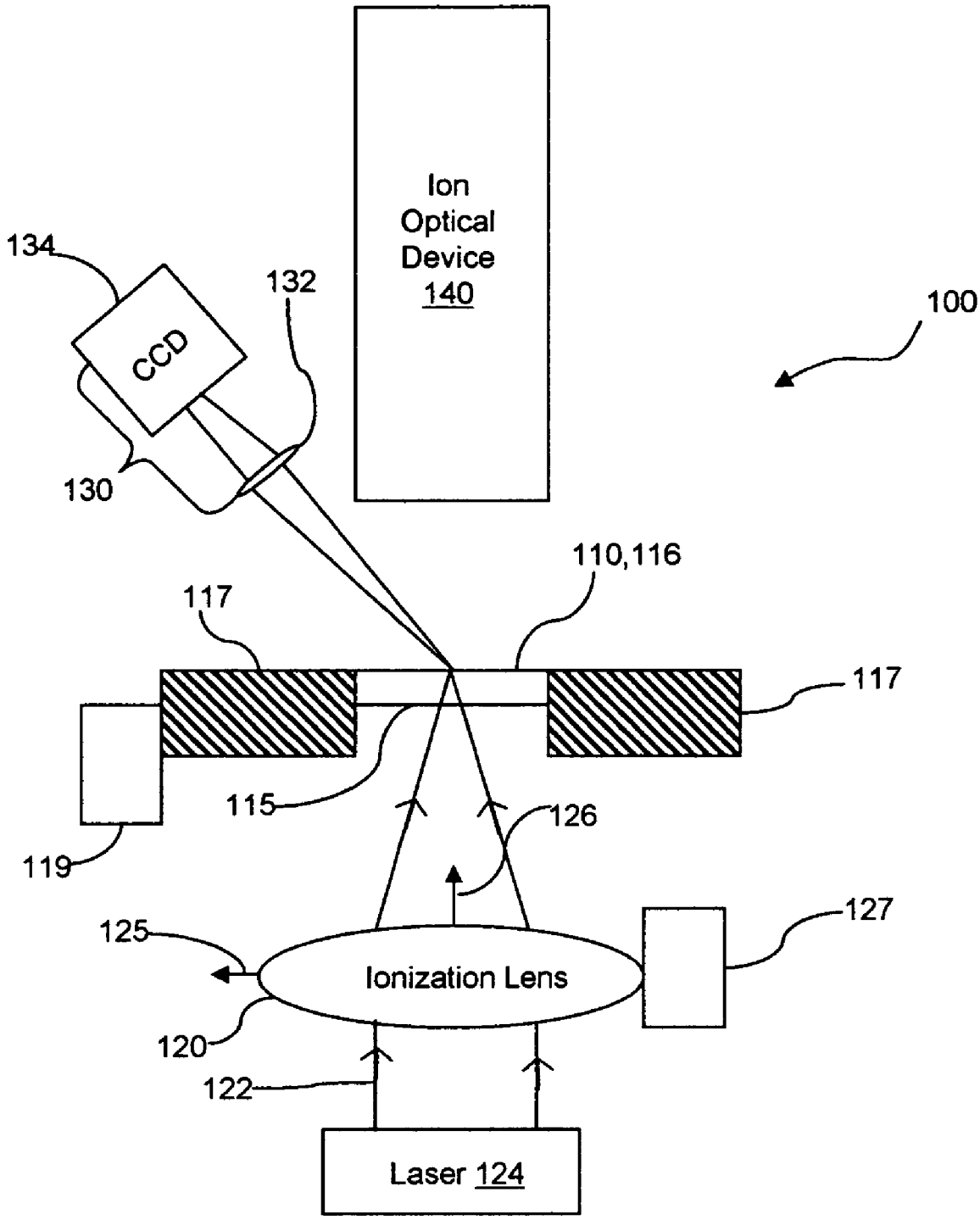
FIG. 1 is an illustration of an LDI/MALDI source according to one embodiment of the invention, wherein beam-focusing optics and an ion optical device are disposed on opposite sides of the sample support.
Figure 2:
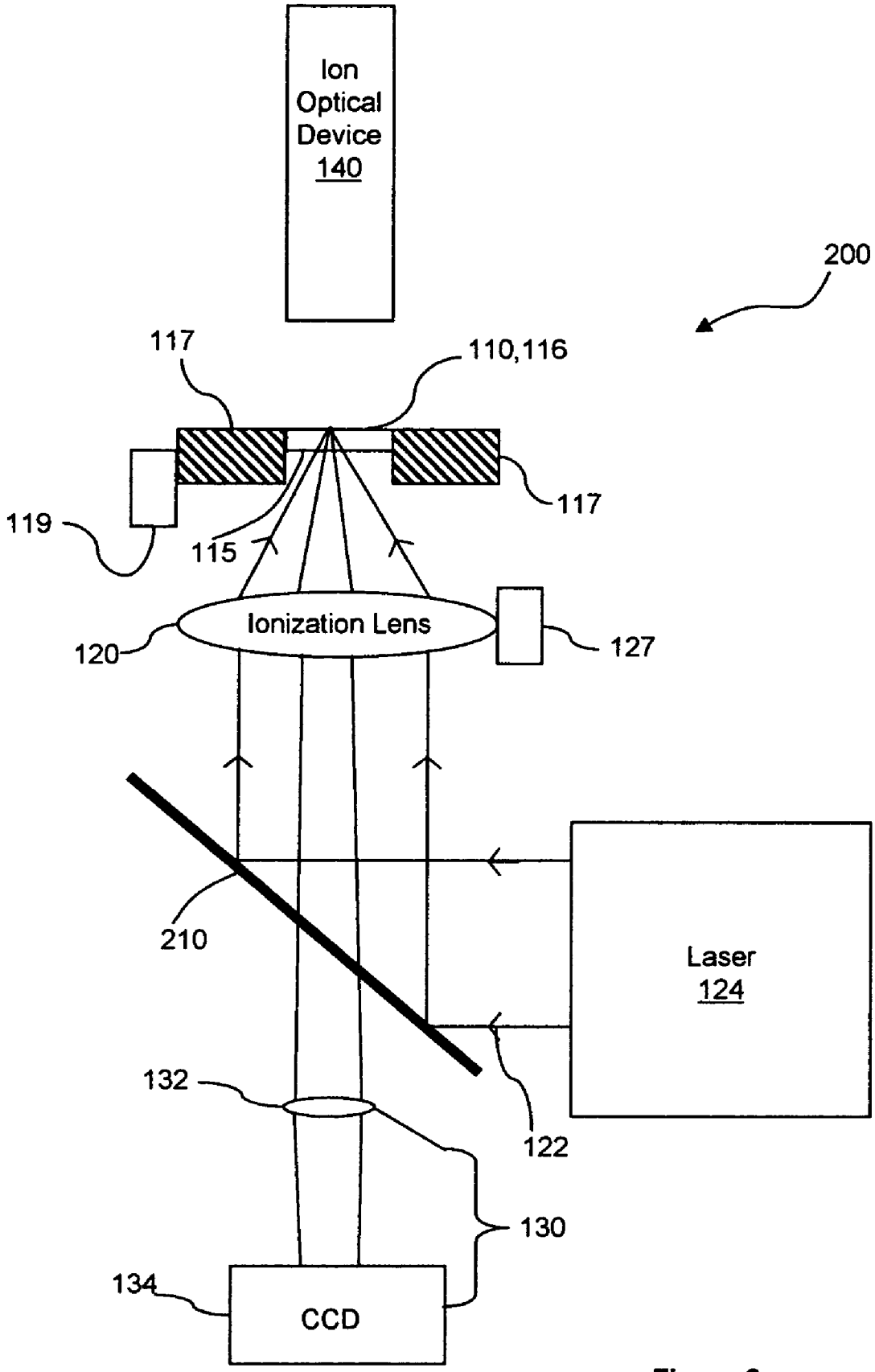
FIG. 2 is an illustration of another embodiment of an LDI/MALDI source, wherein the viewing optics are disposed on the same side of the sample support as the beam-focusing optics.

FIGS. 1–3 illustrate different embodiments of an LDI/MALDI source having various arrangements of beam-focusing and viewing optics. In each of these embodiments, the beam-focusing optics optionally includes a short focal length lens that generates a compact beam spot on the sample.

FIG. 1 is an illustration of an LDI/MALDI source generally designated 100. LDI/MALDI source 100 accommodates a sample support 110, and includes beam-focusing optics 120, viewing optics 130 and an ion optical device 140. Sample support 110 includes a front surface 116, on which one or more samples are deposited, and a rear surface 115. Front surface 116 may be flat and featureless, or may optionally include a conductive coating for application of an offset voltage, one or more chemical reagents configured to react with the analyte, and/or indentations configured to receive and hold the sample.

As noted above, each embodiment of the invention makes use of a transparent sample support. As used herein, the terms "transparent" or "transparency" are not intended to require complete transparency; rather, any sample support may be utilized that allows substantial transmission therethrough of radiation having the wavelength(s) of interest. Furthermore, the sample support may be only locally transparent, i.e., may be transparent only at regions thereof that underlie the sample(s), and the remaining portions of the sample support may be opaque.

In some embodiments, sample support 110 is supported by a positioning stage 117 that is moved with respect to ion optical device 140 and beam-focusing optics 120. A positioning stage driver 119 is configured to move (e.g., translate or rotate) positioning stage 117. Positioning stage driver 119 may includes a stepper motor, piezoelectric device or mechanism known in the art that is capable of precise control of the sample support position. In some embodiments, positioning stage driver 119 is configured to move positioning stage 117 such that a selected one of a plurality of samples on sample support 110 is aligned with the radiation beam and the proximal end of ion optical device 140. In various embodiments, positioning stage driver 119 is configured to move positioning stage 117 with lateral (i.e., in the X-Y plane defined by the sample support) resolutions of 10 micrometers, 5 micrometers, 3 micrometers, 1 micrometer, or less.

Beam-focusing optics 120 are disposed adjacent to rear surface 115 of sample support 110. As used herein, the term "adjacent" does not require immediate adjacency, i.e., the beam-focusing optics should still be considered to be disposed adjacent to rear surface 115 even if one or more structures are interposed between the beam-focusing optics 120 and rear surface 115, or if they are separated by a substantial distance. Rather, the beam-focusing optics should be considered adjacent to the rear surface 115 if they are located in a region that is closer to rear surface 115 than front surface 116. Beam-focusing optics 120 will typically include at least one lens that focuses a beam of radiation 122, which may be supplied by a radiation source, for example laser 124, onto a sample disposed on or near sample support 110 front surface 116. It is noted that beam-focusing optics 120 may, without limitation, consist of a single lens, as depicted in the figures. Laser 124 will typically take the form of a nitrogen or solid-state laser capable of emitting short pulses of radiation at a wavelength or wavelengths that are strongly absorbed by the sample and matrix. In various embodiments, beam-focusing optics 120 are configured to produce a beam spot (the area of the sample impinged by the radiation beam) having a diameter of 10 micrometers, 5 micrometers, 3 micrometers, 2 micrometers, 1 micrometer, or less. In various embodiments, beam-focusing optics 120 have a focal length of 15 millimeters, 12 millimeters, 10 millimeters, 8 millimeters, 5 millimeters, or less. Beam-focusing optics 120 are optionally positioned such that a major axis 125 is approximately parallel to surface front 116 and a center axis 126 is approximately perpendicular to front surface 116. In some embodiments, a combination of laser pulse power and focal length may be selected to effect single-shot desorption/ionization of the irradiated region of the sample. That is, substantially the entire thickness of the sample can be desorbed and ionized at a predetermined location with a single shot of a laser. This could allow for more efficient use of limited sample volumes, enabling results to be attained from a relatively small amount of analyte, and for numerous results to be attained from a single small sample volume.

In some embodiments, laser 124 may operate in a selected one of two modes. In the first mode, the laser illuminates some, or all, of the sample for subsequent visual image acquisition via UV sensitive cameras, for example. In the second mode, the laser irradiates a target region of the sample for production of ions. Operation of the laser in the first mode may be employed, for example, to acquire and display an image that can be viewed by the instrument operator for use in selecting a portion of the sample to be analyzed. Typically, the illumination mode includes a lower beam flux than the ionization mode.

In some embodiments, beam-focusing optics 120 or a portion thereof are mechanically coupled to a lens manipulator 127 configured to move beam-focusing lens 120 relative to transparent sample support 110. For example, in some embodiments lens manipulator 127 is configured to move beam-focusing optics 120 toward or away from front surface 116. In some embodiments, lens manipulator 127 is configured to move beam-focusing optics 120 or other ionization optic parallel to first surface 116. In these embodiments, lens manipulator 127 is optionally used to move the beam spot small distances between different target locations on the sample. Lens manipulator 127 may be operated in conjunction with positioning stage 117 to achieve highly precise control of the beam spot position; for example, movement of positioning stage 117 may provide gross control of the beam spot position, and movement of lens manipulator 127 may provide fine control of the beam spot position. In various embodiments, lens manipulator 127 is configured to move the focal point by 20 micrometers, 10 micrometers, 5 micrometers, 3 micrometers, 2 micrometers, 1 micrometer, or less than 1 micrometer.

Viewing optics 130 are configured for viewing (i.e., acquiring an image of) at least a portion of the sample disposed on sample support 110. An image obtained using viewing optics 130 can be displayed to the operator and used to select a portion of interest of the sample (e.g., a region within a tissue sample) for mass spectral analysis.

Viewing optics 130 typically include at least a focusing element such as a lens 132, reflector, or the like, and a viewing element such as an eye piece or CCD camera 134.

For example, in some embodiments, imaging optics 130 includes CCD camera 134, lens 132 and a microscope aperture (not shown). In some embodiments, viewing optics 130 are configured to detect the incidence of laser beam 122 on the sample. Viewing optics 130 optionally include a visual distance indicator (not shown) configured to assist an operator in manipulating beam-focusing optics 120 using lens manipulator 127 to focus on a desired location within the sample. One or more illumination sources (not depicted in the figures) may be provided to illuminate the sample for viewing and/or image acquisition.

Ion optical device 140 is configured to collect ions desorbed from a MALDI sample disposed on front surface 116 of sample support 110. Ion optical device 140 may comprise, for example, a multipole ion guide to which appropriate AC and DC voltages are applied in order to confine the ions and/or draw the ions along the longitudinal axis of the ion guide. In a typical mass spectrometer architecture, ion optical device 140 transports ions toward a mass analyzer, such as a quadrupole mass filter, ion trap, time-of-flight analyzer, or electrostatic trap, which separates ions according to their mass-to-charge ratios for subsequent detection and/or fragmentation. One or more intermediate chambers as well as various ion optics may be interposed in the ion path between ion optical device 140 and the mass analyzer.

FIG. 2 is an illustration of an LDI/MALDI source 200, which is an alternative embodiment of LDI/MALDI source 100. In this embodiment, both beam-focusing optics 120 and viewing optics 130 are disposed adjacent to rear surface 115 of sample support 110. Viewing optics 130 are configured to acquire an image of a sample disposed on front surface 116 of sample support 110. In this embodiment, beam-focusing optics 120 also functions to focus the sample image, in conjunction with partial reflector 210. Partial reflector 210 is preferably highly reflective at the wavelength of laser 124 so as to direct the laser beam onto the sample and is at least partially transmissive at the wavelength range of visible light so as to enable viewing of the sample image therethrough by camera 134. The wavelength-selective reflection/transmission of partial reflector 210 may be achieved, for example, by application of suitable dielectric layers to one or both surfaces of the reflector. In an alternative configuration, the relative positions of laser 124 and imaging optics 130 are exchanged relative to partial reflector 210.

Figure 3A:
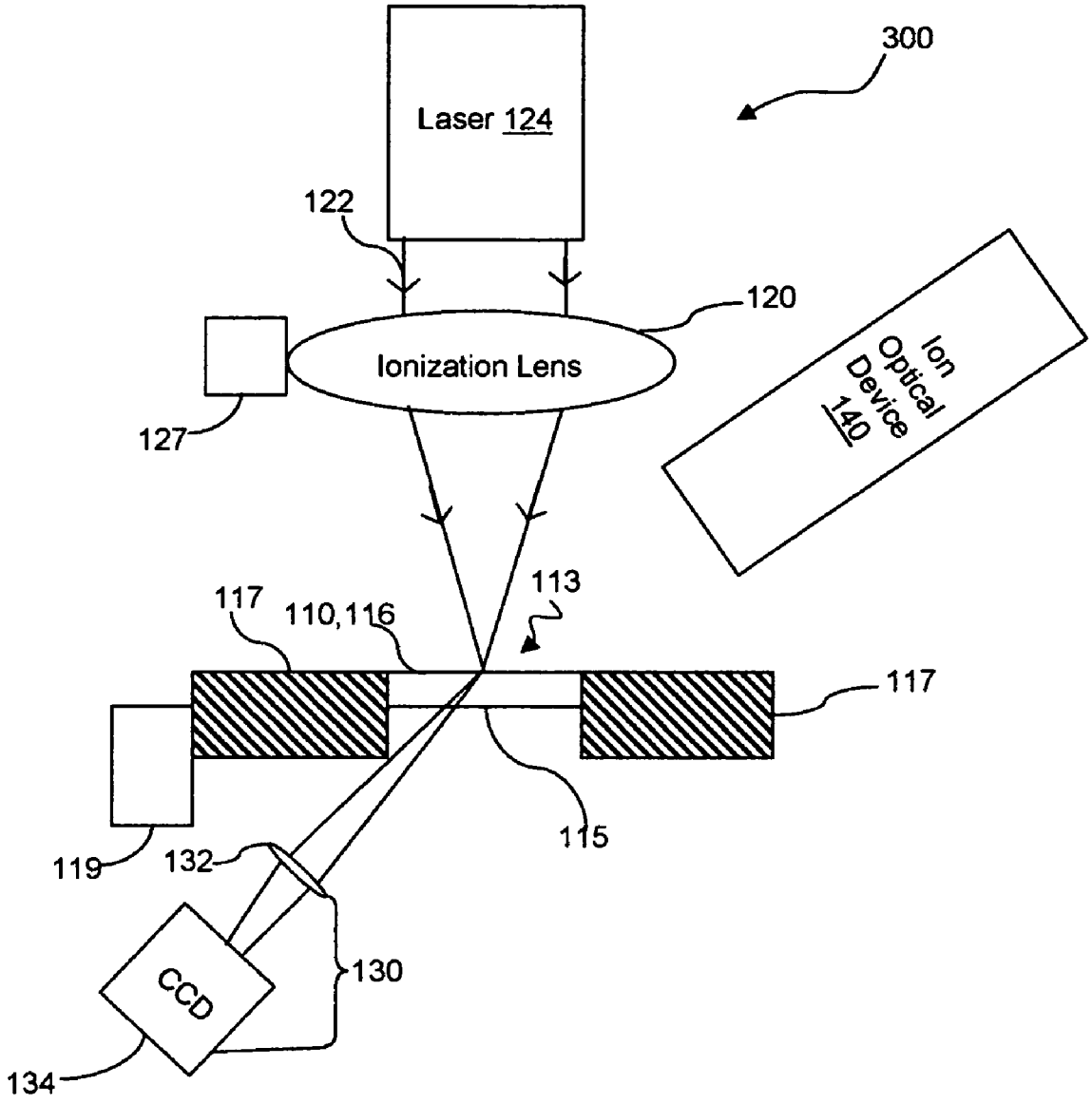
FIGS. 3A and 3B are illustrations of further embodiments of LDI/MALDI sources, wherein the ion optical device and beam-focusing optics are located on the same side of the sample support and the viewing optics are located on an opposite side of the sample support.
Figure 3B:
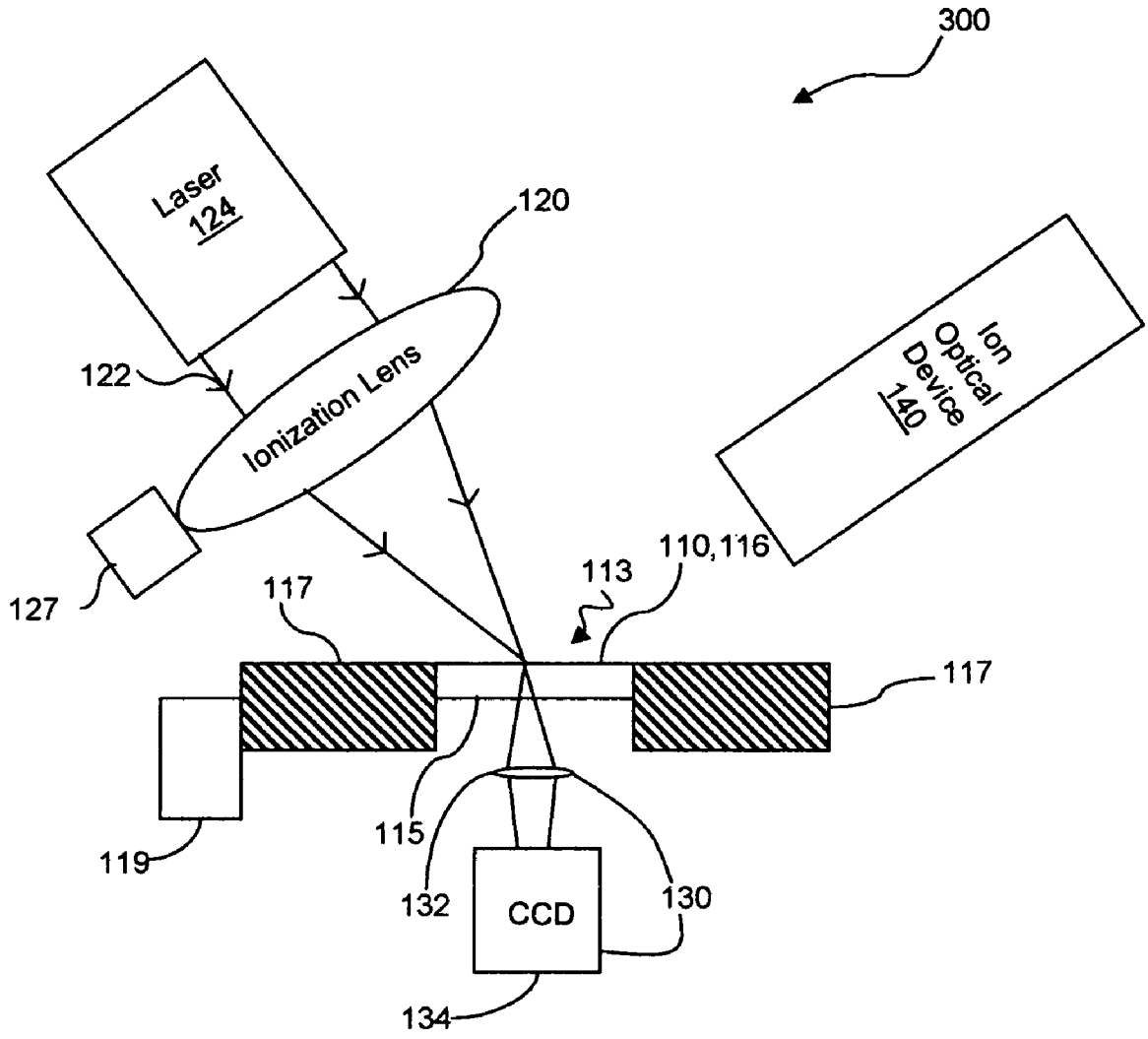

FIG. 3A is an illustration of a MALDI source 300, which is an alternative embodiment of MALDI source 100. In MALDI source 300, imaging optics 130 are disposed adjacent to rear surface 115 of sample support 110, and ion optical device 140 and beam-focusing optics 120 are disposed adjacent to front surface 116 of sample support 110. In this embodiment, ion optical device 140 optionally includes a skimmer configured to collect ions desorbed from a sample disposed on front surface 116. Beam-focusing optics 120 is optionally configured to focus laser beam 122 onto front surface 116 at a perpendicular angle to front surface 116. This orientation will typically produce the minimum spot size of laser beam 122 on the sample. However, in alternative embodiments, beam-focusing optics 120 are configured to focus laser beam 122 onto front surface 116 at other angles of incidence. One example of this arrangement is illustrated in FIG. 3B.

Figure 4:
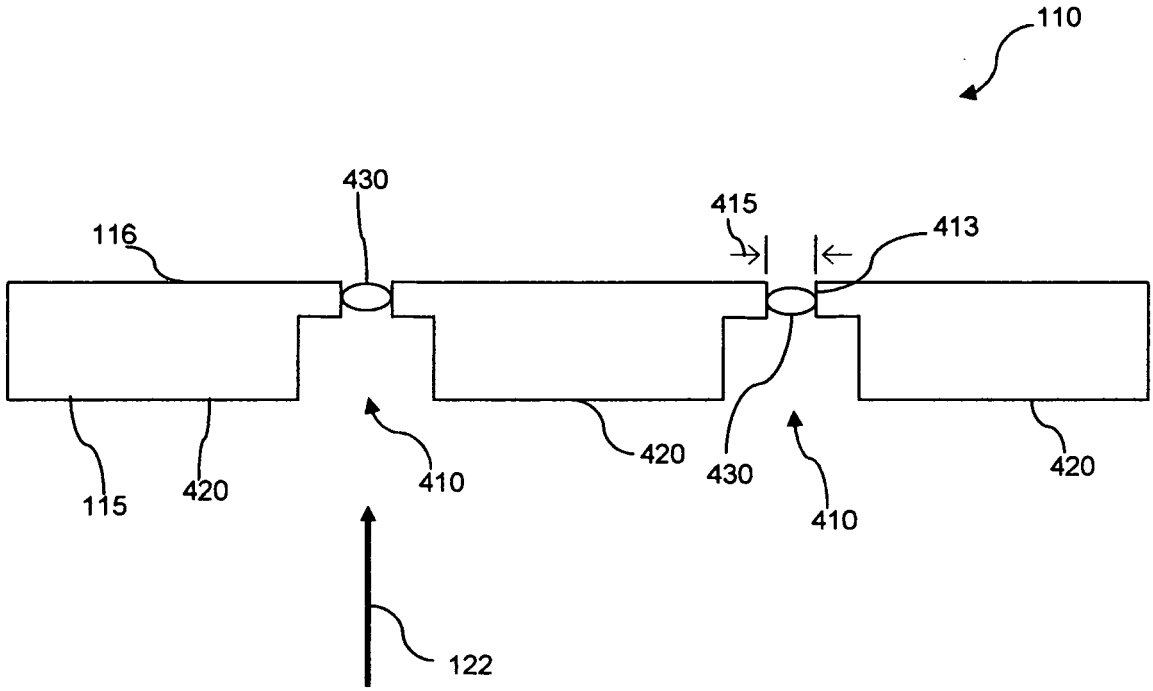
FIG. 4 is an illustration of a transparent sample support, according to various embodiments of the invention.

FIG. 4 is a cross-sectional view of an exemplary implementation of sample support 110, wherein local transparency is achieved by adapting a substrate 420 with openings 410 that underlie the samples 430. Each opening 410 narrows upwardly to a reduced-diameter well 413 having a diameter indicated as 415. A sample 430 may be deposited on sample support 110 by spotting a liquid solution containing the analyte material (and optionally a matrix substance) onto wells 413 and evaporating the solvent. The well diameter 415 should be sufficiently small to allow the liquid solution to be retained in the well by surface tension forces. In various embodiments, wells 413 have a diameter 415 of less than 50 micrometers, 25 micrometers, 10 micrometers or 8 micrometers. In some embodiments, wells 413 are each configured to hold a single cell.

Figure 5:
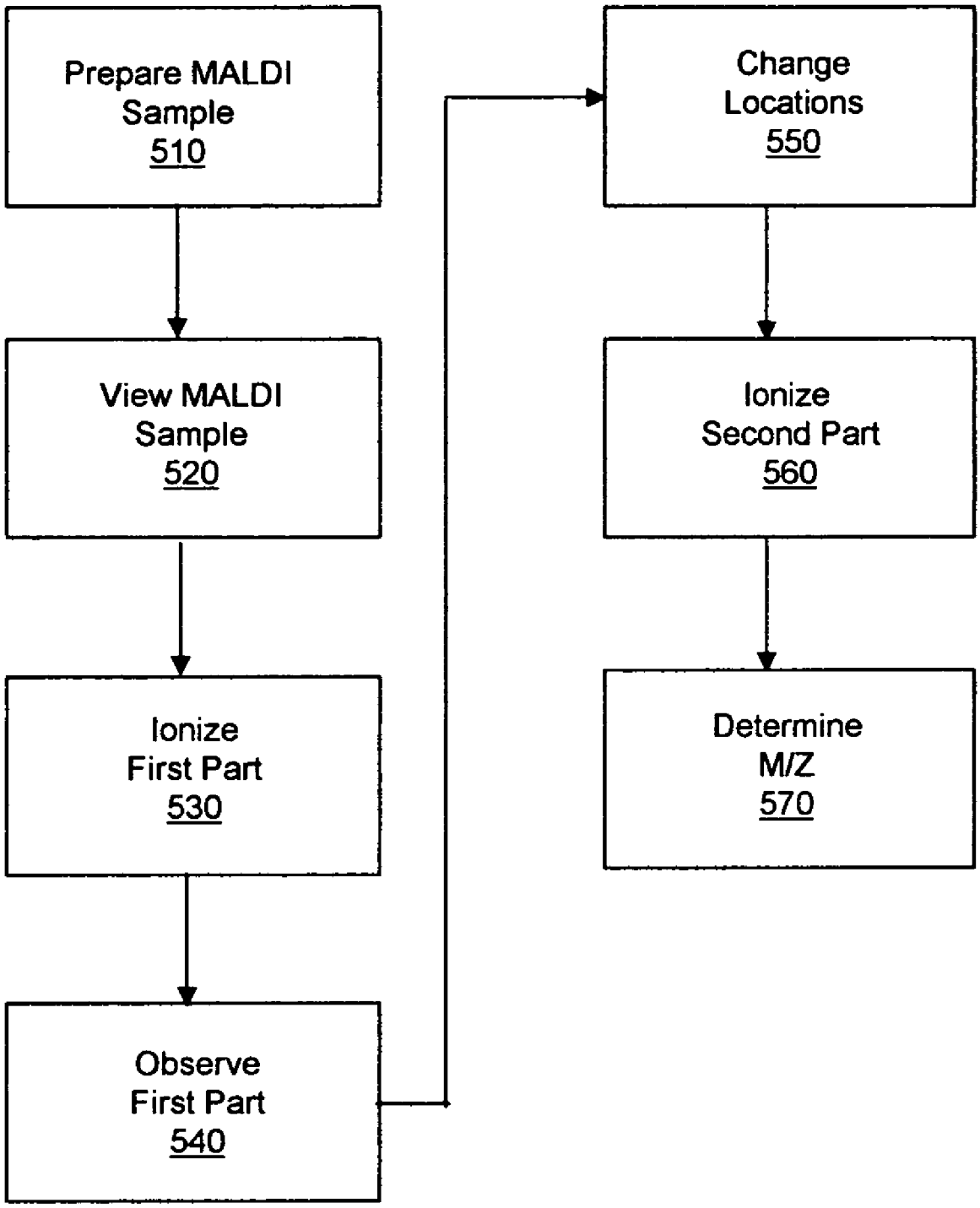
FIG. 5 illustrates a method of analyzing a sample using a mass spectrometer having an LDI/MALDI source, according to various embodiments of the invention.

FIG. 5 illustrates a method of analyzing a sample, according to various embodiments of the invention. In a Prepare MALDI Sample step 510 a MALDI sample is deposited on front surface 116 of sample support 110, for example by adhering a thin tissue layer on the front surface and thereafter applying (e.g., by electrospraying) a matrix layer overlying the tissue.

In an optional View Sample step 520, viewing optics 130 are used to view the sample prepared in Prepare Sample step 510. The sample can either be viewed directly through a microscope aperture, viewed as an image captured using a digital camera, or the like. Typically, the sample is viewed in a magnified form. For example, in some embodiments the view may be in sufficient detail to identify areas of interest within the sample.

In an Ionize First Area step 530, laser 124 is operated to desorb and ionize a part of the MALDI sample located at the focal point of beam-focusing optics 120. Ionization may include simultaneous desorption and ionization or desorption followed by gas phase ionization.

In an Observe First Area step 540, the location of the area of the sample ionized in Ionize First Area step 530 is observed using viewing optics 130. This observation can occur either during the ionization process by imaging the ionization event or following the ionization process by imaging a change (e.g., loss of material) in the sample.

In a Change Locations step 550, the location of the focal point of beam-focusing optics 120 on the sample is moved. This relative movement may be accomplished by moving positioning stage 117 using positioning stage driver 119 and/or by moving beam-focusing optics 120 using lens manipulator 127. Change Locations step 550 is optionally performed while observing the sample through viewing optics 130 and/or using a distance measurement made using viewing optics 130.

Change Locations step 550 is optionally performed while operating laser 124 in the illumination mode. For example, in one embodiment, Change Locations step 550 includes monitoring the position of the focal point of beam-focusing optics 120 by observing light of laser beam 122 striking the sample, while laser beam 122 is operated below a desorption/ionization threshold of the MALDI sample. During this observation, the focal point is optionally moved to a specific part of the MALDI sample to be analyzed. In various embodiments, the change in location of the focal point of beam-focusing lens, that occurs in Change Locations step 550, is less than or equal to 15 micrometers, 10 micrometers, 8 micrometers, 5 micrometers, 3 micrometers or 2 micrometers. In some embodiments, Change Locations step 550 includes moving the focal point of beam-focusing optics 120 from one area of interest in a tissue sample to another.

In an Ionize Second Area step 560, laser 124 is operated in the ionization mode to desorb and ionize a second area of the sample. This second area is that part of the MALDI sample to which the focal point of beam-focusing lens 120 was directed to in Change Relative Locations step 550.

In a Determine M/Z step 570, the mass-to-charge ratios of ions generated in Ionize Second Area step 560 is determined using a mass analyzer to which ions are transported by ion optical device 140 (or which is incorporated into ion optical device 140). These mass-to-charge ratios are optionally used to form a mass spectrum associated with the ionized part of the sample. By repeating Change Locations step 550 and Ionize Second Part step 560, mass spectra associated with different areas of a tissue sample, or other sample, are generated. In alternative embodiments, an instance of Determine M/Z step 150 also follows Ionize First Part step 530.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. An ion source for a mass spectrometer, comprising:

a radiation source for producing a beam of radiation;

beam-focusing optics configured to focus the radiation beam onto a sample disposed on a front surface of a sample support, the beam-focusing optics having a focal length of less than 25 mm and being positioned adjacent to a rear surface of the sample support, the sample support being transparent at the wavelength of the radiation beam so as to transmit the radiation beam therethrough; and an ion optical device positioned adjacent to the front surface of the sample support and being configured to transport ions generated by irradiation of the sample by the radiation beam.

2. The ion source of claim 1, further comprising a positioning mechanism configured to controllably move the sample support relative to the beam-focusing optics.

3. The ion source of claim 1, further comprising a manipulator configured to controllably move the beam-focusing optics relative to the sample support.

4. The ion source of claim 1, further comprising viewing optics for acquiring an image of the sample disposed adjacent to the rear surface of the sample support.

5. The ion source of claim 1, wherein the beam-focusing optics produce a beam spot on the sample having a diameter of less than 5 micrometers.

6. The ion source of claim 1, wherein the beam-focusing optics have a focal length of less than 11 millimeters.

7. The ion source of claim 1, wherein the sample support includes at least one locally transparent window underlying the sample, the area around the window being non-transparent.

8. A mass spectrometer comprising:

a radiation source for producing a beam of radiation;

beam-focusing optics configured to focus the radiation beam onto a sample disposed on a front surface of a sample support, the beam-focusing optics having a focal length of less than 25 mm and being positioned adjacent to a rear surface of the sample support, the sample support being transparent at the wavelength of the radiation beam so as to transmit the radiation beam therethrough; and an ion optical device positioned adjacent to the front surface of the sample support and being configured to transport ions generated by irradiation of the sample by the radiation beam; and a mass analyzer positioned to receive ions and to separate the ions according to their mass-to-charge ratios.

9. The mass spectrometer of claim 8, wherein the beam-focussing optics produce a beam spot on the sample having a diameter of less than 3 micrometers.

10. A method for analyzing a sample by mass spectrometry, comprising steps of:

disposing a sample at or near a front surface of a sample support, the sample support being transparent at an irradiation wavelength in the region underlying the sample;

generating a radiation beam;

focusing the radiation beam using beam-focusing optics having a focal length less than 20 millimeters;

passing the radiation beam through the transparent region of the sample support to impinge on a first area of the sample;

transporting ions produced by irradiation of the sample through an ion optical device to a mass analyzer; and measuring the mass-to-charge ratios of at least a portion of the ion using the mass analyzer.

* * * * *